US007690169B2

(12) United States Patent
Saarenko et al.

(10) Patent No.: US 7,690,169 B2
(45) **Date of Patent: *Apr. 6, 2010**

(54) ROOF CLADDING ELEMENT AND METHOD FOR MANUFACTURING ROOF CLADDING ELEMENTS

(75) Inventors: Pekka Saarenko, Kuopio (FI); Rauno Keinänen, Nilsiä (FI)

(73) Assignee: Samesor Oy, Kuopio (FI)

( * ) Notice: Subject to any disclaimer, the term of this patent is extended or adjusted under 35 U.S.C. 154(b) by 373 days.

This patent is subject to a terminal disclaimer.

(21) Appl. No.: 11/013,610

(22) Filed: Dec. 15, 2004

(65) Prior Publication Data

US 2005/0102930 A1 May 19, 2005

Related U.S. Application Data

(63) Continuation of application No. PCT/FI03/00502, filed on Jun. 19, 2003.

(30) Foreign Application Priority Data

Jun. 19, 2002 (FI) ..... 20021182
Apr. 8, 2003 (FI) ..... 20030524

(51) Int. Cl.
*E04D 1/34* (2006.01)

(52) U.S. Cl. ..... 52/546; 52/535; 52/554; 52/518; 52/528; 52/532

(58) Field of Classification Search ..... 52/535, 52/554, 537, 518, 528, 532, 546, 748.1, 591.4, 52/536, 541; D25/140, 141, 143, 144, 125; 72/177

See application file for complete search history.

(56) References Cited

U.S. PATENT DOCUMENTS 2,002,244 A * 5/1935 Kremper ..... 52/521

(Continued)

FOREIGN PATENT DOCUMENTS

DE 196 44 475 A1 4/1997

(Continued)

*Primary Examiner*—Richard E Chilcot, Jr.
*Assistant Examiner*—Chi Q Nguyen
(74) *Attorney, Agent, or Firm*—Harrington & Smith

(57) ABSTRACT

The present invention relates to a roof cladding element, which roof cladding element has been manufactured of profiled plate material and which roof cladding elements are adjacently and in succession mountable such that the edges of a roof cladding element will be placed a distance overlapping with the edges of adjacent roof cladding elements. The present invention also relates to a method for manufacturing roof cladding elements in which method a plate material in strip form is formed into profiled roof cladding element strip with a forming device and in which method a finished formed roof cladding element strip is cut with a cutting device at even intervals into roof cladding elements. Characteristic to a roof cladding element in accordance with the invention is the fact that to at least one corner of a roof cladding element a recess reaching at least partly under the lower surface of the part of the roof cladding element surrounding the corner has been formed. Characteristic to the method in accordance with the invention is the fact that to at least one corner of the roof cladding element a recess reaching at least partly under the lower surface of the part of the roof cladding element surrounding the corner is formed with a forming device.

7 Claims, 5 Drawing Sheets

U.S. PATENT DOCUMENTS

| | | | | | |
|---|---|---|---|---|---|
| 3,220,150 | A | | 11/1965 | Besse | |
| 3,583,117 | A | * | 6/1971 | Roach et al. | 52/309.1 |
| 4,219,981 | A | * | 9/1980 | Stewart et al. | 52/478 |
| 4,250,728 | A | * | 2/1981 | King | 72/177 |
| 4,251,967 | A | * | 2/1981 | Hoofe, III | 52/535 |
| 4,320,648 | A | * | 3/1982 | Ekmark | 72/301 |
| D273,233 | S | * | 3/1984 | Norgate | D25/140 |
| 4,444,037 | A | * | 4/1984 | Norgate | 72/177 |
| D275,325 | S | * | 8/1984 | Gustavsson | D25/140 |
| 4,499,700 | A | * | 2/1985 | Gustafsson | 52/478 |
| 4,528,835 | A | * | 7/1985 | Ekmark | 72/301 |
| 4,617,773 | A | * | 10/1986 | Studwell | 52/537 |
| 4,754,589 | A | * | 7/1988 | Leth | 52/538 |
| D302,859 | S | * | 8/1989 | Kero | D25/141 |
| 4,932,184 | A | * | 6/1990 | Waller | 52/535 |
| 4,949,522 | A | * | 8/1990 | Harada | 52/533 |
| 5,094,058 | A | | 3/1992 | Slocum | |
| 5,131,200 | A | * | 7/1992 | McKinnon | 52/536 |
| D374,095 | S | * | 9/1996 | Ing | D25/140 |
| 5,752,355 | A | | 5/1998 | Sahramaa | |
| D396,118 | S | * | 7/1998 | Saarenko | D25/140 |
| 6,289,707 | B1 | * | 9/2001 | Saarenko | 72/177 |
| 6,564,523 | B1 | * | 5/2003 | Iole et al. | 52/521 |
| 7,040,001 | B1 | * | 5/2006 | Chuang | 29/564 |

FOREIGN PATENT DOCUMENTS

| | | | |
|---|---|---|---|
| EP | 0 456 273 | A1 | 5/1991 |
| EP | 0 557 973 | A1 | 2/1993 |
| EP | 0 718 449 | A1 | 6/1996 |
| FR | 1 193 592 | | 11/1959 |
| FR | 2 431 583 | | 2/1980 |
| FR | 2 673 435 | | 9/1992 |
| GB | 2 147 027 | A | 5/1985 |
| NO | 5285 | | 3/1895 |
| WO | WO 98/24568 | | 6/1998 |
| WO | WO 98/29619 | | 7/1998 |
| WO | WO 98/31893 | | 7/1998 |
| WO | WO 99/16985 | | 4/1999 |
| WO | WO 99/16986 | | 4/1999 |

* cited by examiner

ROOF CLADDING ELEMENT AND METHOD FOR MANUFACTURING ROOF CLADDING ELEMENTS

The application is a continuation of International Patent Application No. PCT/FI03/00502 filed Jun. 19, 2003.

The present invention relates to a roof cladding element, which roof cladding element has been manufactured of profiled plate material and which roof cladding elements are adjacently and in succession mountable such that the edges of a roof cladding element will be placed a distance overlapping the edges of adjacent roof cladding elements. The present invention relates as well to a method, in which method a plate material in strip form is formed into a profiled roof cladding element strip and in which method a ready formed roof cladding element strip is cut at even intervals into roof cladding elements.

BACKGROUND OF THE INVENTION

Most usually a profiled roof cladding mountable of roof cladding plates is made of roof cladding plates covering the roof from the ridge to the eaves. The roof cladding plates needed in building of a cladding in this way are ordered from a reseller of profiled roof cladding, for example, who delivers the roof cladding plates cut in accordance with the parameters of the roof of the building. Today a profiled roof cladding may also be manufactured of roof cladding elements of standard measures, which are available in stock. This kind of a profiled roof cladding is mounted by attaching roof cladding elements adjacently and in succession to the attaching construction of the roof such that a uniform profiled roof cladding corresponding functionally and in appearance to the cladding manufactured in earlier mentioned method is achieved.

A precondition for functionality of a profiled roof cladding mountable of roof cladding elements is the fact that the edges of roof cladding elements are placed overlapping in longitudinal and transverse directions as requires the shape of the cladding, among other things. Since the roof cladding elements are mounted as said there appears to be four plate layers one on the other at the junction point of the edges, one on the other, of roof cladding elements that are placed adjacently and in succession (that is at the corners of roof cladding elements) and in other connection points of the edges there are only two layers. This is why there is a difference in thickness between the corners and the other edges that are overlapping, and therefore between overlapping edges there appears to be gaps. The gaps worsen tightness and make the cladding non-uniform in appearance. To solve this problem a roof cladding element has been designed from one lower corner of which and from diagonally with that placed other upper corner of which pieces are cut (that will say so called notching has been carried out), and such there will not be four plate layers of cladding one on the other at the roof cladding element corners. This kind of a roof cladding element has been presented in the international patent application document WO9916985.

By means of notching disadvantages caused by the four overlapping plate layers are prevented. However, cutting of corners causes many other problems. Notching will leave waste, which increases material and manufacturing costs and hence worsens the profitability of manufacturing. The notching causes points of non-continuance in the plate material strip to be formed which points cause problems in manufacturing process of the product as well as ready points of notching may be damaged during transportation. In addition, due to notching there will appear sharp corners and edges in the product, which easily cause various accidents at work while handling and mounting roof cladding elements. In addition, the notching requires additional devices in manufacturing process of roof cladding elements, which devices make it more expensive and more vulnerable for various production disturbances than conventional methods. Furthermore, the cladding constructed of notched roof cladding elements is more easily thought to be more vulnerable for leaking of running water than the cladding constructed of unnotched roof cladding elements.

The purpose of the invention is to provide a roof cladding element, with the use of which the earlier mentioned disadvantages related to present roof cladding elements are eliminated. Especially, the purpose of the invention is to provide a roof cladding element, with the use of which the disadvantages due to four overlapping plate layers are eliminated but by means of which the notching of roof cladding elements and problems due to it are eliminated. In addition, the purpose of the invention is to provide a roof cladding element which may be attached to other roof cladding elements and the attaching construction of cladding long-lasting and reliably but with less separate attaching elements and with less mounting work with regard to those than earlier. Furthermore, the purpose of the invention is also to provide a method for manufacturing a roof cladding element in accordance with claim 1.

DESCRIPTION OF THE INVENTION

Characteristic to a roof cladding element in accordance with the invention is the fact that to at least one corner of a roof cladding element a recess reaching at least partly lower than the lower surface of the part of the roof cladding element surrounding the corner has been formed. Due to this kind of a recess the four plate layers placed one on top of the other in the cladding may be mounted such that there will be no gaps at other points of the edges. Therefore, due to this kind of a recess there is no need to notch the roof cladding elements such eliminating the problems due to said notching.

In an advantageous application of the roof cladding element in accordance with the invention in the steps of the roof cladding element there is at least one locking recess in order to lock at least one step of a roof cladding element to the next lower roof cladding element and in the upper part of a roof cladding element there is at least one attaching shoulder in order to attach the upper edge of the roof cladding element to the attaching construction of the cladding as well as to tighten and lock at least the locking recesses placed nearest to the lower edge of the roof cladding element to the locking recesses placed in the upper part of the next lower roof cladding element. By means of this kind of locking recesses the roof cladding elements may be attached to each other, which decreases the number of necessary separate attaching elements as well as makes it quicker and easier to mount the cladding. Especially, when a step with a locking recess is placed in the lower edge of the cladding a cladding construction well standing wind loads tearing off cladding elements is achieved. Due to attaching shoulders in the upper part of the roof cladding element the locking recesses of the steps placed one on another of the two roof cladding elements in succession may be tightened in mounting easily and quickly against one another such that the attachment of the lower edge of the roof cladding element formed by the locking recesses will not be loose and noise making in the wind but it will be long-lasting, soundless and tight.

In the second advantageous application of the roof cladding element in accordance with the invention the recess is at least of the size of the part of the corner of the adjacent roof cladding element on the recess in the ready cladding. In this way there will not appear any empty gaps between the corner of the other roof cladding element on the recess and the formed edge of the recess and, on the other hand, the corner on the recess will not cross the edge of the recess but the corner fills the recess completely thus forming as even as possible base for the next layer on the connection.

In the third advantageous application of the roof cladding element in accordance with the invention the depth of the recess at other points than at the point of the vertical part of the step mainly equals the thickness of the roof cladding element to be placed on the recess and the depth of the recess at the point of the vertical part of the step mainly equals twice the thickness of the roof cladding element to be placed on the recess. In this way the upper level of the corner of the other roof cladding element to be placed on the roof cladding element is possible to have on the same level with the upper level of the surrounding area of the recess thus making an even base in direction of thickness for the next plate layer. In addition, due to the recess with the depth twice the thickness of the plate placed at the point of the step the adjacent roof cladding elements are possible to place exactly to the same point in longitudinal direction of the cladding. In this way it is possible to prevent the obliqueness of the transverse connection joints of the corners due to many plate layers one on top of another typical to conventional roof cladding elements without notching.

In the fourth advantageous application of the roof cladding element in accordance with the invention the edges formed to the recess are mainly in the shape of the edges of a part of the corner of the roof cladding element to be placed on the recess. In this way the corner of the roof cladding element to be mounted next into the recess of the former roof cladding element may be mounted as jointless as possible and such that it stays well at the point and is thus easily mountable into the recess.

In the fifth advantageous application of the roof cladding element in accordance with the invention the lower edge of the roof cladding element is at the point of the vertical part of the step or in a small distance after it and the recess reaches from above the step to the vertical part of the step. In order to create as jointless construction as possible it is advantageous to place transverse connection joints of the cladding at the steps. While using recesses reaching the vertical part of a step gaps in the vertical part and obliqueness of the transverse connection joints of the cladding due to many plate layers one on top of another at this point are eliminated.

Characteristic to the method in accordance with the invention is the fact that a recess reaching at least partly under the lower surface of the part of the roof cladding element surrounding the corner is formed to at least one corner of a roof cladding element with a forming device. In this way it is possible to create recesses included in roof cladding elements in accordance with the invention simply and advantageously with present forming devices of roof cladding elements without great changes and additional accessories in devices.

In an advantageous application of the method in accordance with the invention the recess is formed with the forming device of the step in connection with the forming of the step. Due to the construction of the recess the manufacturing of it is possible to carry out by forming to the cladding plate to be manufactured with some pressing tool. Since the manufacturing of the recess is carried out in connection with the forming of the step there is no need for separate forming devices except currently known forming devices but the recess may be created simply and advantageously by means of an additional forming device placed to a suitable forming device of the step.

In the second advantageous application of the method in accordance with the invention the cutting device is moved to the point, which is placed in a desired distance after the last step of the roof cladding element to be cut off, and the cladding element strip is cut. A cladding element strip stepped in this way may be cut at desired point without extra cutting phases and waste pieces from those of currently known methods.

In the third advantageous application of the method in accordance with the invention the forming device of the step is moved to the point of the front edge of the roof cladding element strip and a step is formed to the roof cladding element strip. In this way the first step after the cutting of the strip is possible to have always in the desired point on the front edge of the strip (that is on the lower edge of the roof cladding element), without cutting a waste piece between the upper edge of the former roof cladding element and the lower edge of the next roof cladding element.

DESCRIPTION OF THE DRAWINGS

Next, the invention will be explained in more detail with reference to the accompanying drawings, in which.

Figure 1:
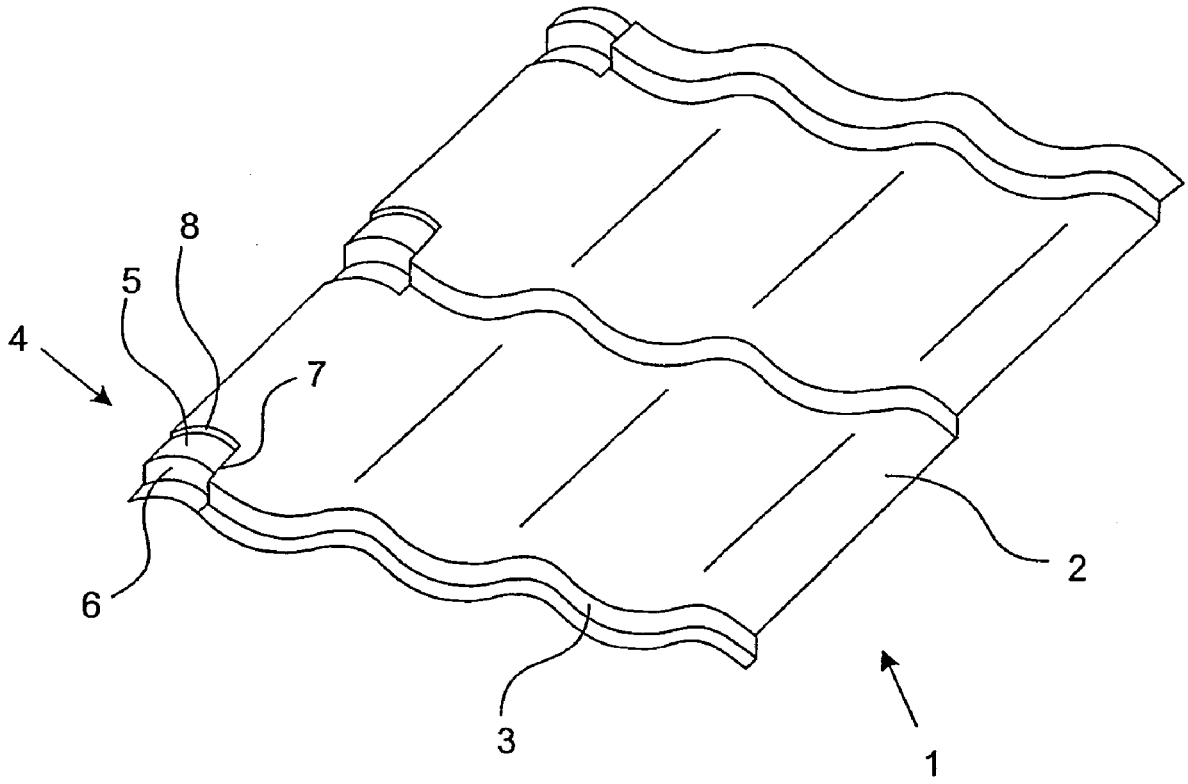
FIG. 1 illustrates a roof cladding element in accordance with the invention viewed diagonally from above.

The roof cladding element 1 in accordance with FIG. 1 has been manufactured of a thin metal plate rolled open from a reel by forming and cutting the formed roof cladding element strip to roof cladding elements of desired length. The roof cladding element 1 includes the longitudinal profiling 2 illustrated in figures such that the cross-section of the roof cladding element is waved. In addition, in the roof cladding element there are transverse steps 3 at even intervals such that the formed roof cladding element strip reminds in appearance of a roof made of bricks. Furthermore, the roof cladding element includes a recess 4 formed to the left lower corner viewed from the direction of FIG. 1 at the point of the steps which recess reaches under the lower surface of the part of the roof cladding element surrounding it. The depth of the recess equals the thickness of the plate at the horizontal area 5 and at the point of the vertical part of the step 6 the depth equals twice the thickness of the plate. The size of the recess is approximately the same as the corner of another roof cladding element to be mounted on the recess and the formed edges 7 and 8 of the recess have been formed to be in the shape of the edges of the corner of the roof cladding element to be placed on the recess.

A profiled roof cladding is formed of the roof cladding elements in accordance with the invention in recognized way by attaching roof cladding element in succession and adjacently such that the edges of the roof cladding elements are placed one on top of the other as is presumed for the tightness and jointless appearance of the cladding. Roof cladding elements are mounted in such an order that the overlapping prevents the rain water to run to the lower surface of the cladding.

Figure 2:
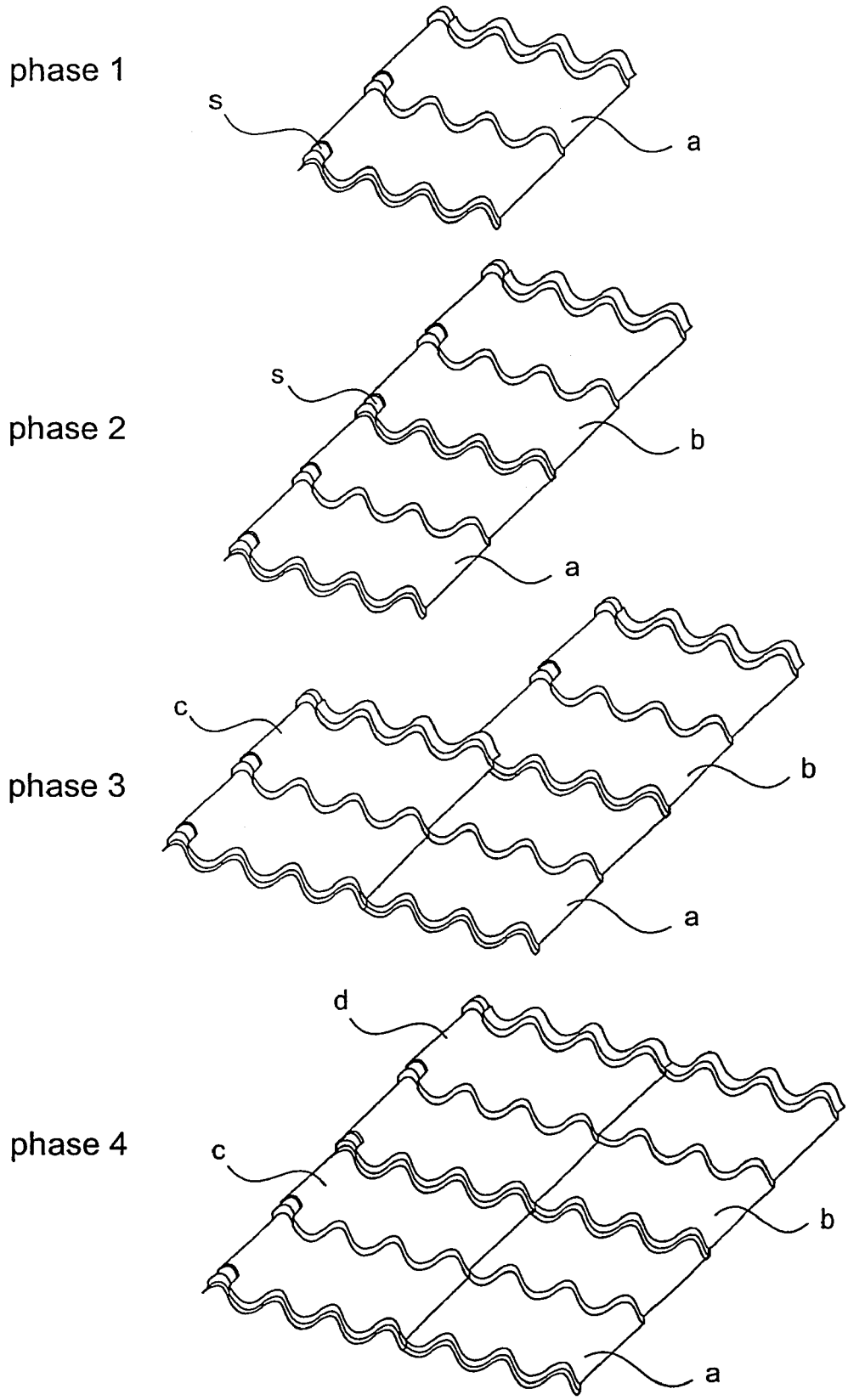
FIG. 2 illustrates the mounting in phases of four adjacent and successive roof cladding elements in accordance with FIG. 1.

For example, while attaching the roof cladding elements in accordance with FIG. 1 to a roof four adjacent and successive roof cladding elements are mounted in order in accordance with FIG. 2 as follows: first the roof cladding element a is attached. Next the roof cladding element b is mounted above the roof cladding element a such that the lower edge of the roof cladding element b will be placed on the upper edge of the roof cladding element a. After this to the left side of the roof cladding element a roof cladding element c is mounted such that the right upper corner of the roof element c is placed on the recess s on the left lower corner of the roof cladding element b. Due to the recess the depth of which equals the thickness of the roof cladding element the upper surface of the upper corner of the roof cladding element c and the upper surface of the area of the left lower corner round the recess s of the element b are approximately on the same level. In addition, since the depth of the recess s in the element b is twice the thickness of the roof cladding element at the point of the vertical part of the step, the vertical part of the uppermost step of the element c, with regard to the step of the element b, is one thickness of the plate in longitudinal direction of the roof cladding element upper. After this next to the element b above the element c the element d is mounted, the right side edge of which will be placed on the left side edge of the element b, and the lower corner of which will be placed on the upper corner of the element c. Since the upper corner of the roof cladding element c and the left edge of the roof cladding element b are placed in thickness direction of the plate due to the recess s approximately at the same level, may the roof cladding element d be placed on the roof cladding elements c and b such that there will be no gaps at the connection points. In addition, since the vertical part of the step of the roof cladding element c is one thickness of the plate upper than the vertical part of the step of the roof cladding element b, may the roof cladding element d be placed next to the roof cladding element b such that the vertical parts of the steps included in roof cladding elements b and d are placed at the same point in longitudinal direction of the cladding. Therefore, due to the recess the depth of which is twice the thickness of the roof cladding element formed at the point of the step the transverse connection joints of the adjacent roof cladding elements in the ready cladding are straight while viewed from side.

Figure 3:
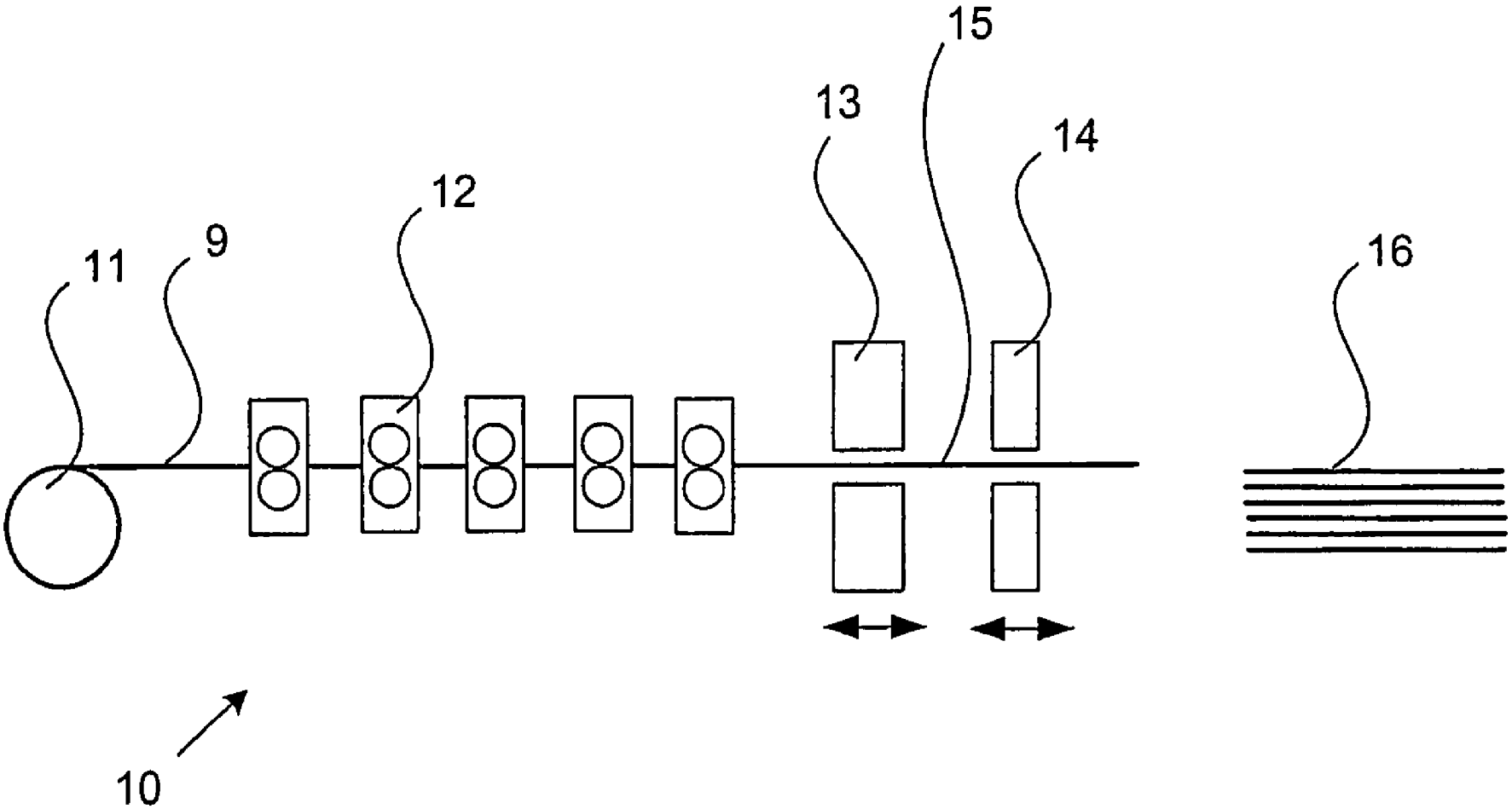
FIG. 3 illustrates a principle drawing of a production line applicable in manufacturing of roof cladding elements in accordance with earlier mentioned figures.

In FIG. 3 a production line 10 applicable for manufacturing roof cladding elements in accordance with the invention is presented. It comprises an opening device 11 of a reel for opening of a thin plate strip 9 from a reel, a roll forming device 12 for forming of longitudinal profile, a step forming device 13 for forming of steps and a cutting device 14 for cutting of a strip 15 formed to be a roof cladding element strip into roof cladding elements 16. These devices are by their construction and function mostly earlier recognized, hence only their additional functions and accessories required by the invention are explained. For example, the step forming device 13 includes apart from its earlier recognized parts the forming device located in connection with the upper pressing tool and the lower pressing tool, by which forming device the earlier described recess is pressed to the steps of the roof cladding elements. In this case as a forming tool for the recess a shoulder in the shape of the recess formed to the upper tool of the step forming device and a recess in the shape of the shoulder formed to the lower tool are acting. The step forming tool may be fixed hence forming a recess to all steps. Alternatively, the shoulder in the upper and lower tools of the step forming device and corresponding recess may be regulable by actuators such that the recess may be formed only, for example, to steps placed in the lower edge of the roof cladding elements.

In those roof cladding elements in accordance with the invention, which include steps at even intervals the lower edge has been placed at the point of the vertical part of the step or in a small distance after it. In order to have the lower edge in all roof cladding elements at the point in accordance with FIG. 1 it would be necessary to cut a waste piece after cutting the strip while using methods at present in use in order to have the first step of the next roof cladding element to the lower edge of the roof cladding element. In order to avoid this the forming device 13 and the cutting device 14 of the step in the production line in accordance with FIG. 1 have been attached longitudinally with regard to the roof cladding element strip movably to the production line 10. Devices may be alternatively movable together or separately from each other.

Figure 4:
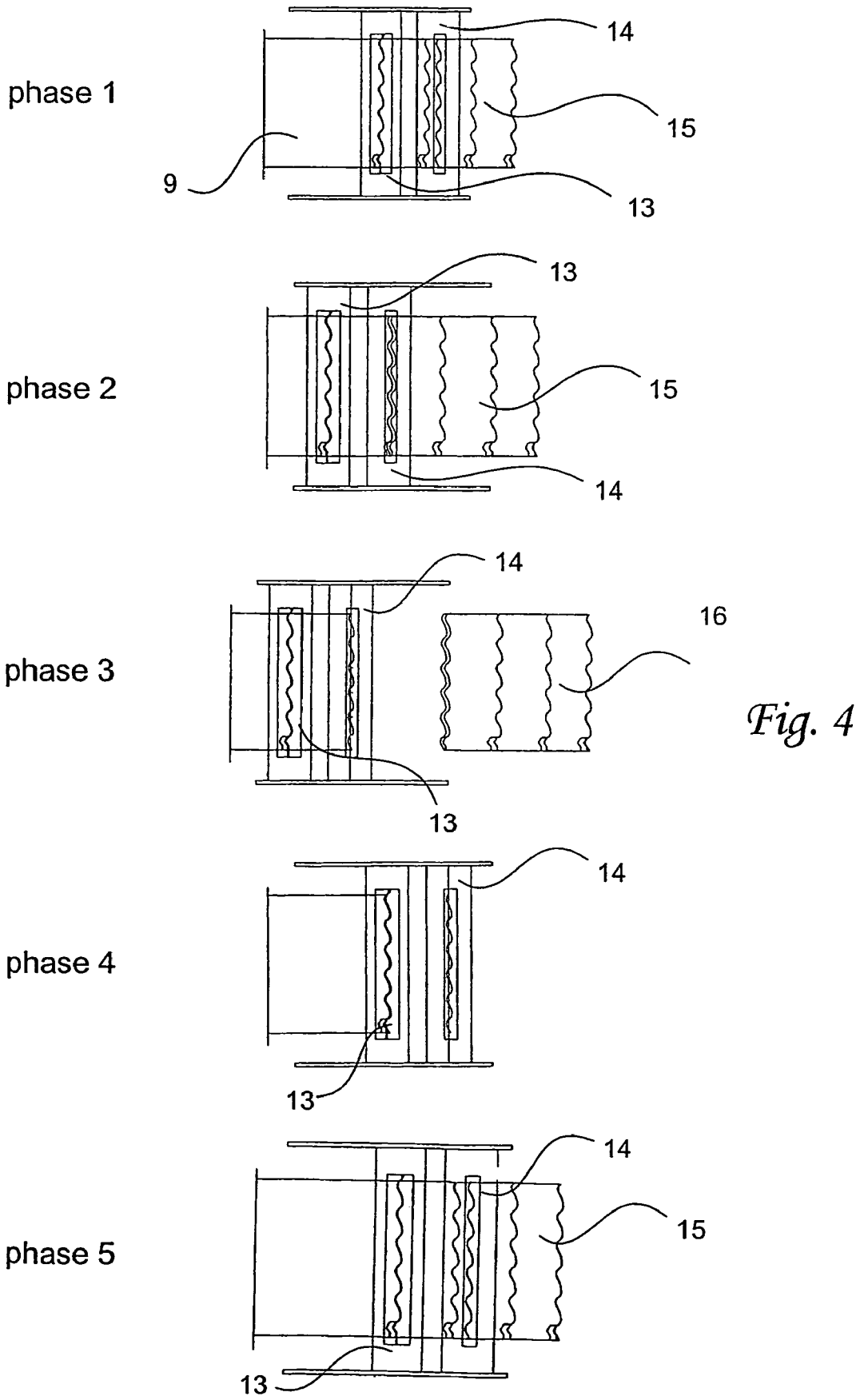
FIG. 4 illustrates the principle of the forming of the step and the cutting of roof cladding elements on a production line in accordance with the FIG. 4 in phases.

By means of movably attached forming device of the step and the cutting device may the lower edge of roof cladding elements be placed at the point of the step, for example, in the way illustrated in FIG. 4 and as follows: in the beginning of the phase 1 the first step is formed when the end of the strip has moved to the point of the forming device 13 of the step. After this during the phase 1 at even intervals steps are formed as many as defined by the length of the roof cladding element and the distance between the steps until the last step included in the first roof cladding element has been formed. In the phase 2 the cutting device 14 is moved to the point of the cutting point of the first roof cladding element, which is usually 10-20 mm after the last step. In the phase 3 the roof cladding element strip is cut whereupon the first ready roof cladding element is manufactured. In the phase 4 the forming of a new roof cladding element is started by moving the forming device of the step such that the first step may be formed to the front edge of the profiled strip. In the phase 5 the forming device of the step and the cutting device are moved back to the initial position. After this the manufacturing continues starting from the phase 1 forward until the desired number of roof cladding elements has been manufactured.

Figure 5:
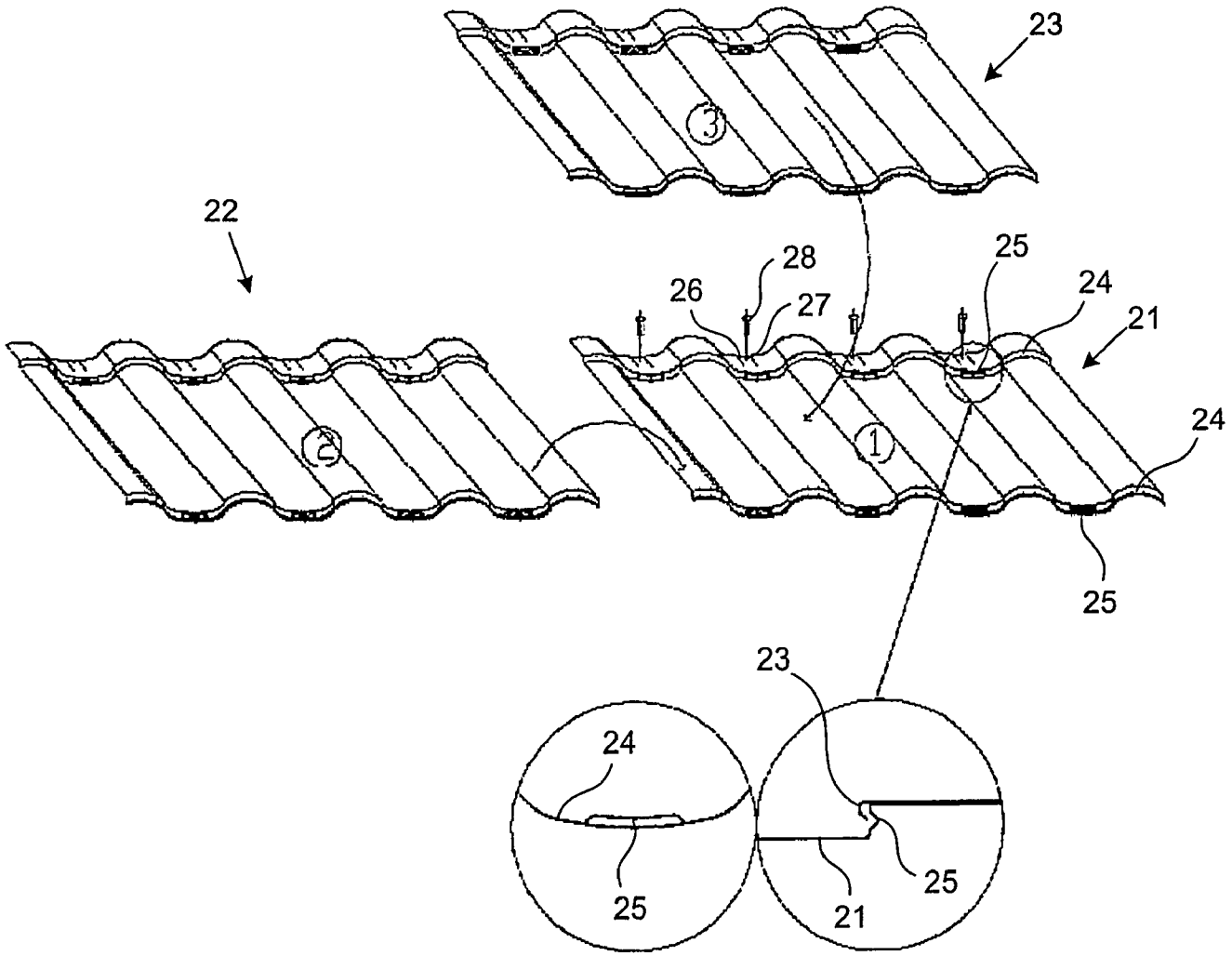
FIG. 5 illustrates another roof cladding element in accordance with the invention and the principle of its mounting.

In FIG. 5 there is another roof cladding element in accordance with the invention presented. It also comprises similar to the application in FIGS. 1 and 2 recesses (not illustrated in FIG. 5) in the left edge of the steps 24 to prevent the forming of gaps in the finished cladding. In addition, it includes locking recesses 25 in the shape of a letter V on its side by longitudinal cross-section viewed from side illustrated in magnification of FIG. 5 in the vertical part as well as attaching shoulders 26 formed to the upper edge of the roof cladding element, which shoulders have attaching openings 27 for attaching elements 28. The locking recesses 25 have been manufactured by means of a forming tool of the locking recess mounted in the forming device of the step. It is a press in the shape of the locking recess, which presses the locking recess in connection with forming of the step. The attaching shoulders 26 have been manufactured in connection with the cutting of the roof cladding elements by means of a perforator included in the cutting device. Also the attaching openings may be manufactured by means of perforators mounted in connection with the blades of the cutting device or, for example, in a separate phase later.

A cladding is mounted as presented in FIG. 5 in accordance with earlier the presented application. In the case in accordance with FIG. 5 all roof cladding elements to be mounted into the lowest row (roof cladding elements 21 and 22 for example) are attached with separate additional attaching elements (not illustrated in FIG. 5) between the lower part of the roof cladding element and the battens acting as the attaching construction of the roof. In roof cladding elements placed in succession the lower edge of the upper roof cladding elements (roof cladding element 23 for example) is placed on the uppermost step of the lower roof cladding elements. The locking recesses 25 in the steps are tightened within each other when the roof cladding elements are attached from the attaching shoulders 26 with the attaching elements 28. In this way the roof cladding elements may be mounted from their lower part to the upper part of the roof cladding elements being placed lower, and where the attaching shoulders 26 attached to the battens of the lower roof cladding elements are placed. The mounting method applied in roof cladding element in accordance with FIG. 5 increases the strength of the roof cladding element against wind load. Therefore it is advantageous especially for so called horizontal elements the width of which is greater than the length.

The roof cladding element in accordance with the invention is not limited to above presented application examples. Naturally, the size of the roof cladding element, the shape of the profile as well as the number, shape and the height of the steps included in the roof cladding elements may vary. The roof cladding element may be mountable from the top, in which case the heads of the fastening screws of a roof cladding element will appear on the uppermost plate layer in the finished cladding or they are hidden mountable, in which case the attaching elements of a roof cladding element are placed such that they are hidden under the edge of the next upper roof cladding element. In the roof cladding element in accordance with FIG. 1 there is a recess in one edge of each step included in a roof cladding element. It would be enough, in principle, to have manufactured a recess only to the lower edge of the lowest step. It should be noticed, however, that this would, to some extent, complicate the manufacturing process of roof cladding elements and, on the other hand, there is no disadvantage if the recess was manufactured to all steps, since in the finished cladding they will always be placed hidden under the edge without a recess of the next adjacent roof cladding element. For example, the lower edge of the roof cladding element is usually placed at the point of the vertical part of a step or in a small distance after it. In some application the lower edge may be placed, for example, near the upper part of the vertical part of a step. In an application akin to the roof cladding element in accordance with FIG. 1 the lower edge at the point of the vertical part has been bent to the inner surface side of the roof cladding element such that the end of the plate points mainly upwards. In this case leaking water has no entry to the cutting point in the lower edge of the cladding. This decreases rusting of the lower edge of a roof cladding element as well as due to the curved shape of the lower edge the connection joints of a finished cladding may be manufactured imperceptible or changing the appearance of the cladding in a desired way by placing a connection joint in a suitable way. In addition, the rounding of the edge due to bending decreases risks of injuries due to the sharp cutting edge while handling the roof cladding elements.

In applications akin to FIG. 5 the longitudinal cross-section of the locking recess to be formed to the vertical part of the step need not necessary be in the shape of a letter V on its side in accordance with the figure. The locking recess may, alternatively, be curved, right-angled or some suitable combination of these by shape. There may be locking recesses in every valley of a transverse profile as well as at the points of peaks of profiles or, for example, in every second valley and the width of a locking recess may, naturally, vary depending on the shape of the transverse profile. The attaching shoulders in the upper part of the roof cladding element are parts of the roof cladding element, which reach under the lowest part of the lower surface of the valley of the transverse profile such that the attaching elements (nails or screws, for example) mounted on the attaching shoulders do not bend the upper edge of the roof cladding element. Therefore, attaching shoulders may be depressions formed into the upper edge of a roof cladding element instead of bellows manufactured by cutting, which depressions correspond by shape to bellows illustrated in FIG. 5 in mounted roof cladding element. In case so called self-drilling screws are employed as attaching elements there is no need for ready attaching openings in attaching shoulders. In some applications attaching shoulders may be recesses somewhat greater by diameter than the head of the attaching element, for example, round by shape or in some other shape, in the middle of which there is an attaching opening for a nail, screw or some other attaching element.

Also the method in accordance with the invention for manufacturing roof cladding elements in accordance with the invention may vary. For carrying out earlier recognized manufacturing phases, such as forming the longitudinal profile, for example, may, in principle, whatever earlier recognized forming and cutting devices of plate material be employed. The forming of the recess included in roof cladding element in accordance with the invention may be carried out in connection with other forming phases or separate from them. In those applications in which the recess is manufactured in connection with the forming of a step, it is advantageous to place a tool in connection with the upper and/or lower tool of the forming device of the step. While manufacturing roof cladding elements in accordance with FIG. 1 the recess has been manufactured with a shoulder fixed mounted in the upper tool of the forming device and a recess in the shape of the shoulder formed in the lower tool. In case the recess is manufactured only to the point of the lowest step, the forming tool of recess must function such that it forms a recess only to the point of the lowest step. This may be realized such, for example, that an actuator moving the shoulder forming the recess is mounted to the upper tool of the forming device of the step, by means of which actuator the shoulder may be drawn inside the upper tool for the time the other than the lowest step are formed. Furthermore, the forming tools of the recess may be regulable such that the depth and/or the size of the recess may be changed, for example, with regard to the thickness of the plate and/or the shape of the roof cladding elements when needed.

The invention is not limited to the presented advantageous applications but it can vary within the frames of the idea of the invention formed in the claims.

The invention claimed is:

1. A roof cladding element comprising:

a body comprising plate material which has been cut and formed into a profiled shape, wherein the roof cladding element is mountable adjacent and in succession with other roof cladding elements such that edges of the roof cladding element will be placed a distance overlapping with edges of adjacent ones of the roof cladding elements, wherein the roof cladding element comprises at least one step mainly transverse with the cladding element, and wherein the roof cladding element comprises a plurality of corners, wherein a first recess is provided in at least one of the corners which is bounded by at least one surrounding portion of the roof cladding element, wherein the first recess extends below a lowest surface of all surrounding portions of the roof cladding element, and wherein the first recess is located only at the at least one corner.

2. A roof cladding element in accordance with claim 1, wherein in an upper part of the roof cladding element there is at least one attaching shoulder for attaching the upper part to an attaching construction as well as for tightening and locking a locking recess of the roof cladding element to a locking recess of another roof cladding element.

3. A roof cladding element in accordance with claim 1, in which the recess is sized and shaped to receive a part of a corner of an adjacent roof cladding element that will be on the recess.

4. A roof cladding element comprising plate material which has been cut and formed into a profiled shape, wherein the roof cladding element is mountable adjacent and in succession with other roof cladding elements such that edges of the roof cladding element will be placed a distance overlapping with edges of adjacent ones of the roof cladding elements, wherein the roof cladding element comprises at least one step mainly transverse with the cladding element, and wherein the roof cladding element comprises, at least in one corner of the roof cladding element, a recess which is bounded by at least one surrounding portion of the roof cladding element, and wherein the recess extends below a lowest surface of all surrounding portions of the roof cladding element, in which a depth of the recess is mainly the same as a thickness of the roof cladding element at the recess except at a point of a vertical part of the step, and the depth of the recess at the point of the vertical part of the step is about twice the thickness of an adjacent roof cladding element on the recess.

5. A roof cladding element in accordance with claim 1, in which edges formed to the recess are shaped to matingly receive a part of a corner of an adjacent roof cladding element to be mounted on the recess.

6. A roof cladding element comprising plate material which has been cut and formed into a profiled shape, wherein the roof cladding element is mountable adjacent and in succession with other roof cladding elements such that edges of the roof cladding element will be placed a distance overlapping with edges of adjacent ones of the roof cladding elements, wherein the roof cladding element comprises at least one step mainly transverse with the cladding element, and wherein the roof cladding element comprises, at least in one corner of the roof cladding element, a recess which is bounded by at least one surrounding portion of the roof cladding element, and wherein the recess extends below a lowest surface of all surrounding portions of the roof cladding element, in which the lowest surface of the surrounding portions is at a point of a vertical part of the step or at a small distance after the vertical part of the step, and the recess extends to the vertical part of the step from a location above the step.

7. A roof cladding element comprising:

a step extending across a majority of a width of the cladding element;

a locking recess located in the step for locking the roof cladding element to a next lower roof cladding element;

an attaching shoulder in an upper part of a roof cladding element, wherein the attaching shoulder is adapted to attach the upper part of the roof cladding element to an attaching element for attaching the roof cladding to another member, and wherein the attaching shoulder is adapted to tighten and lock at least one locking recess of another roof cladding element to the upper part of the roof cladding element; and a lower recess in only a bottom corner of the roof cladding element, wherein the lower recess in the bottom corner of the roof cladding element extends at least partly below a lowest surface of the step.

* * * * *